US009067378B2

(12) United States Patent
Wetsch et al.

(10) Patent No.: US 9,067,378 B2
(45) Date of Patent: Jun. 30, 2015

(54) INFLATION AND SEALING DEVICE WITH ROTARY CUTTER

(75) Inventors: Thomas D. Wetsch, St. Charles, IL (US); Vitoldas Karaliukas, Oak Brook, IL (US); Thomas F. McNellis, Tinley Park, IL (US)

(73) Assignee: Pregis Innovative Packaging Inc., Dearfield, IL (US)

( * ) Notice: Subject to any disclaimer, the term of this patent is extended or adjusted under 35 U.S.C. 154(b) by 358 days.

(21) Appl. No.: 12/496,272

(22) Filed: Jul. 1, 2009

(65) Prior Publication Data

US 2010/0024961 A1 Feb. 4, 2010

Related U.S. Application Data

(60) Provisional application No. 61/077,428, filed on Jul. 1, 2008.

(51) Int. Cl.
*B31D 5/00* (2006.01)

(52) U.S. Cl.
CPC ..... *B31D 5/0073* (2013.01); *Y10T 156/12* (2015.01); *B31D 2205/0047* (2013.01); *B31D 2205/0058* (2013.01); *B31D 2205/0082* (2013.01)

(58) Field of Classification Search
CPC ..... B31D 5/0073
USPC ..... 156/145, 256
See application file for complete search history.

(56) References Cited

U.S. PATENT DOCUMENTS 2,327,468 A * 8/1943 Stocker ..... 156/88
2,976,567 A * 3/1961 Jones et al. ..... 264/146
3,085,459 A * 4/1963 McDermott ..... 83/431
3,695,131 A * 10/1972 Zimmermann ..... 83/56
3,941,306 A 3/1976 Weikert
5,203,761 A 4/1993 Reichental et al.
5,327,805 A * 7/1994 Reichental et al. ..... 83/471.2
5,468,525 A 11/1995 Watts
5,794,500 A * 8/1998 Long et al. ..... 83/22
6,209,286 B1 * 4/2001 Perkins et al. ..... 53/403
6,932,134 B2 8/2005 Selle et al.

(Continued)

FOREIGN PATENT DOCUMENTS

WO 2008/042929 A1 4/2008

OTHER PUBLICATIONS

European Patent Office; Partial European Search Report for EP 09164319, Jan. 21, 2014; 6 pages.

(Continued)

*Primary Examiner* — Jeff Aftergut
(74) *Attorney, Agent, or Firm* — Dorsey & Whitney LLP

(57) ABSTRACT

An inflatable-cushion inflation and sealing device is disclosed. The device includes an inflation assembly configured for inflating with a fluid a cushion cavity disposed between first and second layers of film. The inflation assembly includes a fluid conduit configured for longitudinal reception between first and second overlapping portions of an inflation channel adjacent to and in fluid communication with the cushion cavity. The device further includes a cutting element disposed proximate the fluid conduit and configured and 10 oriented to cut open inflation channel by a cutting motion that includes rotation thereof. Also, the device includes a sealing assembly configured to seal the overlapping portions to each other and to form a longitudinal seal configured to seal the fluid in the cushion cavity.

26 Claims, 7 Drawing Sheets

(56) References Cited

U.S. PATENT DOCUMENTS

| | | | | |
|---|---|---|---|---|
| 7,124,753 | B2 * | 10/2006 | Sung | 125/12 |
| 2003/0118778 | A1 * | 6/2003 | Perkins et al. | 428/166 |
| 2004/0206050 | A1 * | 10/2004 | Fuss et al. | 53/403 |
| 2006/0042191 | A1 | 3/2006 | Lerner et al. | |
| 2006/0251833 | A1 | 11/2006 | Gavin et al. | |
| 2006/0292320 | A1 | 12/2006 | Greenwood et al. | |
| 2008/0066852 | A1 | 3/2008 | Wetsch et al. | |
| 2008/0193263 | A1 | 8/2008 | Wetsch | |
| 2009/0094939 | A1 | 4/2009 | Wetsch | |

OTHER PUBLICATIONS

European Patent Office, Extended European Search Report dated Aug. 5, 2014 for Application No. 09164319.7, 11 pages.

* cited by examiner

INFLATION AND SEALING DEVICE WITH ROTARY CUTTER

FIELD OF THE INVENTION

The invention relates to the manufacturing and handling of packaging materials, and more particularly to a device for handling inflatable air cushions that are used as packaging material.

BACKGROUND OF THE INVENTION

Devices are known for inflating flexible structures, such as inflatable air cushions or pillows (hereinafter referred to as "cushions") that are used for filling empty space in a package to provide protection to an object during packaging and transportation thereof. One example of an inflation and sealing device is disclosed in U.S. Pat. No. 6,932,134. The device disclosed therein uses a set of drive rollers and a belt assembly to guide an inflation channel formed in the preconfigured film over an inflation assembly and a sealing assembly to 15 form cushions in the preconfigured film. The inflation channel is then cut free from the inflation nozzle using a fixed blade located downstream of the inflation and sealing assemblies.

U.S. Pat. No. 6,209,286 discloses an inflation and sealing device for forming packaging cushions that uses a fixed blade to cut the inflated cushions free from the inflation assembly after sealing of the cushions. A cutter is also shown for cutting along perforations in the inflated film to separate individual cushions. U.S. Publication No. US 2006/10292320 also discloses using a fixed blade to cut open the inflation channel.

An improved cutting mechanism is needed for such devices.

SUMMARY OF THE INVENTION

The present invention relates to a film handling device. The device includes a driver configured for engaging a plastic film for driving the film along a path and a cutting element that is operable for rotating with respect to the film for slicing the film. In an embodiment, the film can include first and second overlapping layers associated for providing cushion cavities to seal a fluid therein for providing package cushions. In such an embodiment, 30 the cutting element can be operable for slicing open an inflation channel in the film. Alternatively, the handling device can include a plurality of traction members configured for engaging a chain of pre-inflated package cushions connected to each other end-to-end. In such an embodiment, the driving mechanism is operably associated with the traction members for drawing the chain from an input location to an output location from which the pillows are dispensed, and the cutting element is configured to separate adjacent cushions by detaching at 5 least one of the cushions from the chain. Further, the cutting element can be operable for linear motion in a direction perpendicular to the path to slice the film between adjacent package cushions.

Another embodiment relates to an inflatable-cushion inflation and sealing device. The device includes an inflation assembly configured for inflating with a fluid a cushion cavity disposed between first and second layers of film, the inflation assembly including a fluid conduit configured for longitudinal reception between first and second overlapping portions of an inflation channel adjacent to and in fluid communication with the cushion cavity. The device further includes a cutting element disposed proximate the fluid conduit and configured and oriented to cut open the inflation channel by a cutting motion that includes rotation thereof and a sealing assembly configured to seal the overlapping portions to each other and to form a longitudinal seal configured to seal the fluid in the cushion cavity.

Preferably the first and second overlapping portions are juxtaposed against one another on two sides of inflation channel and the cutting element is configured and oriented to cut open inflation channel to provide an exit from the channel for the conduit. In a preferred embodiment, the cutting element is in the form of a disk having a sharpened, substantially circular outer edge. The disk can be made from steal and can includes a treatment or coating on the outside edge to improve the hardness thereof. The cutting element can be affixed to a motor configured to cause the rotation of the cutting element.

In a further embodiment, the fluid conduit includes a recessed portion, and the cutting element is positioned relative to the fluid conduit so as to partially extend into the recessed portion. Further, the fluid conduit further can include an outlet configured for supplying fluid into the cushion cavity and an inlet for receiving a fluid to be supplied into the cushion cavity. The recessed portion is preferably disposed between the inlet portion and the outlet. Further, the fluid conduit can be configured such that the first overlapping portion extends over the recessed portion, and wherein a portion of the cutting element extends into the recessed portion so as to cut open the inflation channel in an area where the first overlapping portion extends over the recessed portion. For example, the cutting member can be in the form of a disk having a diameter of between about 0.7 inches and 2 inches, and the cutting member can extend into the recessed portion by a distance of between about 0 and 0.2 inches.

In a further embodiment the sealing assembly is configured for receiving the first and second overlapping portions and for cooperatively driving the overlapping portions along a sealing direction to form the longitudinal seal. The rotation of the cutter is preferably carried out in the sealing direction at a speed that is faster than the speed at which the overlapping portions are driven.

Another aspect of the present invention relates a method for inflating and sealing an inflatable cushion. The method includes inflating a cushion cavity disposed between first and second layers of film by directing a flow of a fluid through an inflation channel adjacent to and in fluid communication with the cushion cavity such that the fluid flows into the cushion cavity. The inflation channel is formed from two overlapping portions of the film that are juxtaposed with one another on two sides of the inflation channel. The method further includes cutting open the inflation channel using a rotating cutting disk, and sealing the overlapping portions to each other so as to form a longitudinal seal configured to seal the fluid in the cushion cavity.

DETAILED DESCRIPTION OF THE PREFERRED EMBODIMENTS

Figure 3:
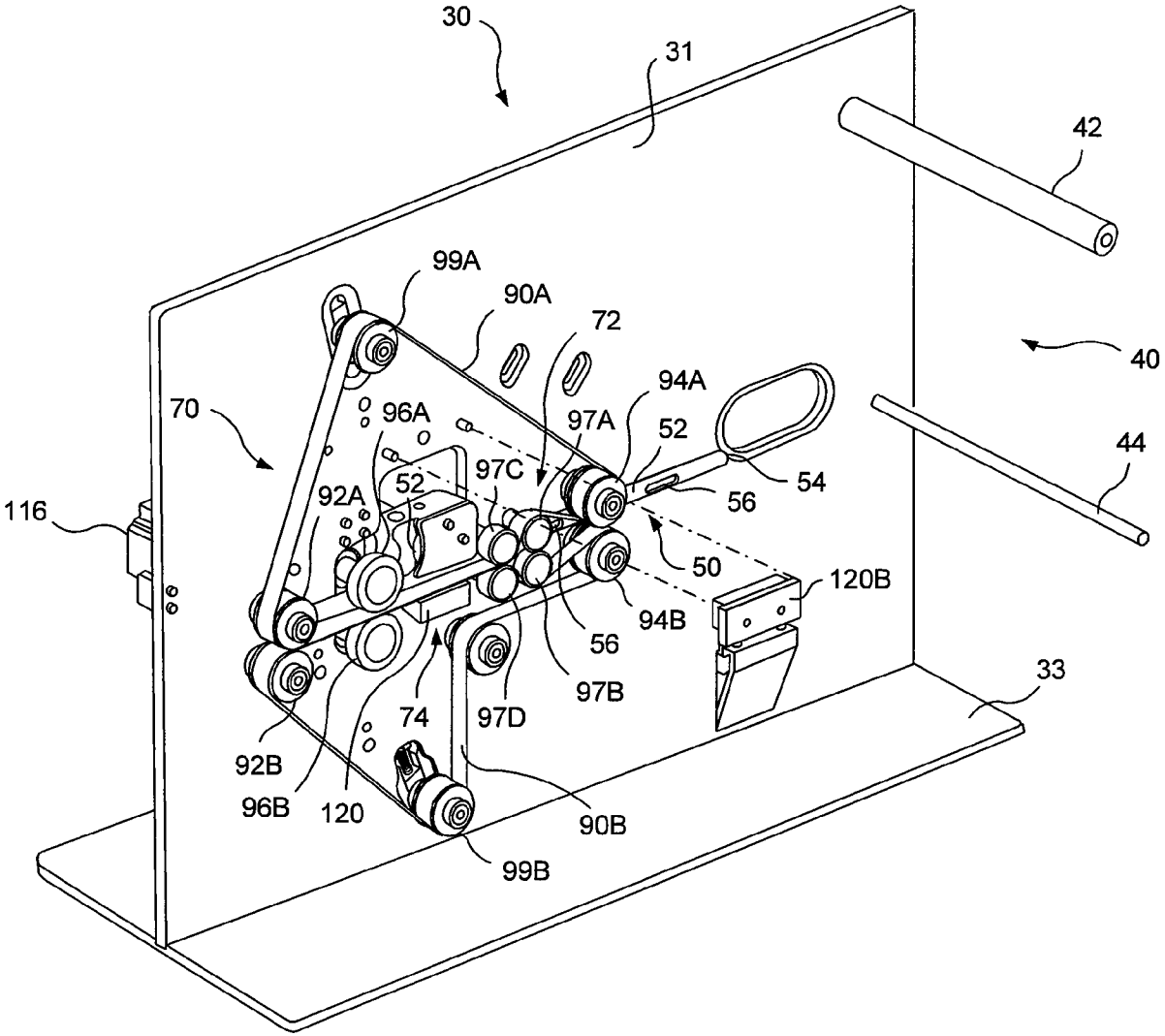
FIG. 3 is a perspective view of an inflation and sealing device according to an embodiment of the present invention having a portion thereof shown in an exploded view to show internal components.

Referring to FIG. 3 a preferred embodiment of a device according to the present invention can be used with suitable uninflated film structures or materials to form a variety of suitable inflatable structures or cushions, such as inflatable cushions with longitudinal axes that can be, for instance, oriented longitudinally, transversely, or in any other pattern with respect to the longitudinal axis of the film. Examples of such film structures are disclosed in U.S. Application Publication No. 2006/0251833, the entire content of which is expressly incorporated herein.

Figure 1:
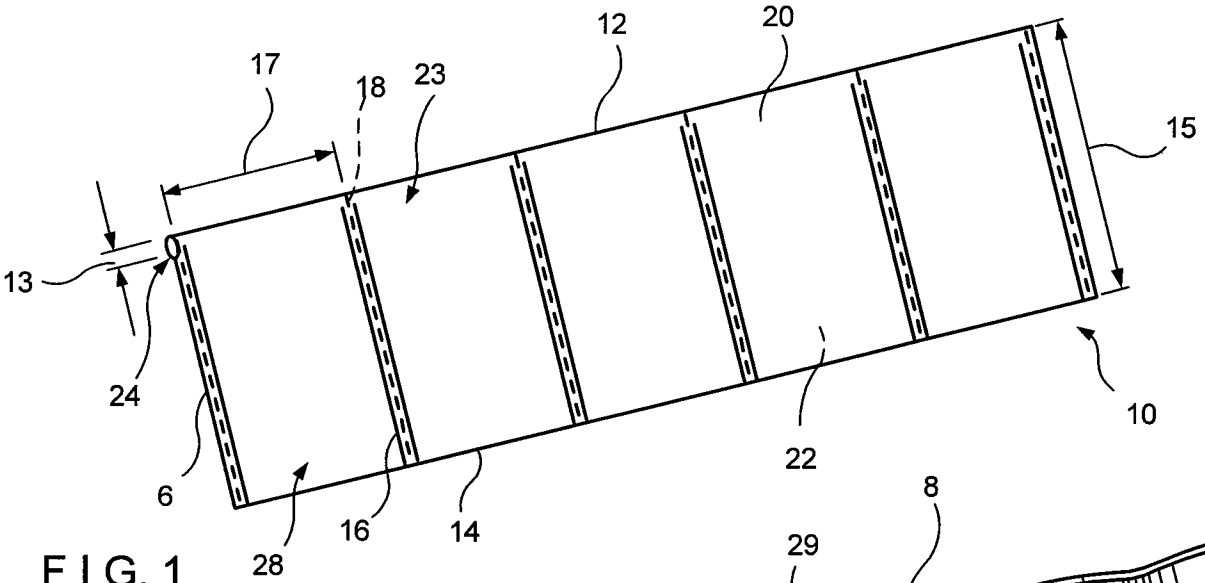
FIG. 1 is a perspective view of an embodiment of a film of uninflated cushions that can be inflated and sealed by a device constructed according to the invention.
Figure 2:
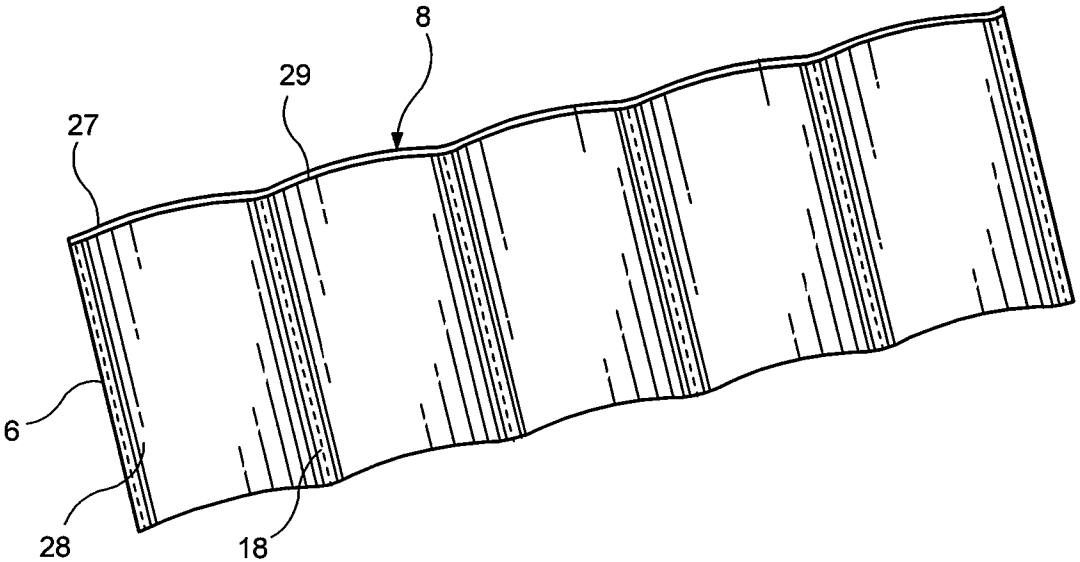
FIG. 2 is a perspective view thereof after inflation and sealing by the device.

FIG. 1 shows an example of a film material 10 that can be used with the device to make inflatable cushions. Upon inflation, film 10 forms a series of transversely-oriented cushions attached at perforated edges, as shown in FIG. 2. The film 10 can be made of any of a variety of different materials.

Film 10 has a first longitudinal edge 12 and a second longitudinal edge 14, both of which are preferably closed or joined. Film 10 has a lead end 6, and also includes generally transverse seals 16, which each include a line of weakness 18, such as perforations or a score line. Transverse seals 16 join a first film layer 20, such as a top layer, of the film 10 to a second film layer 22, such as a bottom layer, of the film 10 along the seals, and, together with the closed, second longitudinal edge 14, define an inflation cavity of each cushion 28. The first and second film layers 20,22 define a major surface or plane of the film 10. The transverse perforations 18 perforate the film 10 through the first and second film layers 20,22 to facilitate separation of each cushion 28 from each other. Other embodiments can have an inflation channel remote from the edge, such as in the center, for example to form inflated chambers on opposite sides of the inflation channel.

In an embodiment, first and second film layers 20,22 are attached to each other along the second longitudinal edge 14, but are unattached to each other along first longitudinal edge 12 prior to inflation. Such a configuration can be formed from a single layer of film material, a flattened tube of film material with one edge slit open, or two separate layers of film material. For example, the first and second film layers 20,22 can include a single sheet of film material that is folded over itself to define the attached second longitudinal edge 14 (i.e., "c-fold film").

Film 10 has a width 15, and a perforation-to-perforation length 17, which may be selected depending on the particular type of cushion being manufactured. In the embodiment shown in FIG. 1, transverse seals 16 begin at second longitudinal edge 14 of film 10, and extend transversely up to a distance 13 from first longitudinal edge 12. Because transverse seals 16 do not extend all the way to first longitudinal edge 12 of film 10, opening 24 is defined between each end of transverse seal 16 and first longitudinal edge 12 of film 10. The area of film 10 between opening 24 and the overlapping film layers adjacent first longitudinal edge 12 defines a continuous, longitudinal inflation channel 23 having a width defined by distance 13. Opening 24 at lead end 6, is generally used to feed inflation channel 23 of film 10 over an inflation nozzle of an inflation device when loading the film to the device. The width of inflation channel 23 is preferably configured to produce a tight, or in some embodiments a friction-fitting, association over the inflation nozzle to prevent or substantially reduce air leakage during inflation. Advantageously, this reduces the amount of compressed air required for inflation, and minimizes the size of the compressor and power utility requirements of the inflation device. In the embodiment of FIG. 2, each inflated cushion 28 can be separated from a neighboring inflated cushion by a transverse line of weakness 18, although such may not be necessary. As a remnant of the manufacturing process explained below, small cutaway flaps 27 are left on the inflated film 10 adjacent to first longitudinal edge 12. The manufacturing process also forms a longitudinal seal 29 along a sealing or overlapping portion 8 of the inflated film 10 (defined by the overlapping edge portions of film layers 20,22), so that each inflated cushion 28 is sealed closed, trapping the inflation fluid, which is preferably a gas and more preferably air, within the cushion. Longitudinal seal 29 is preferably substantially straight, but in other embodiments, can have curved, zig-zag, or other non-linear configurations.

Figure 4:
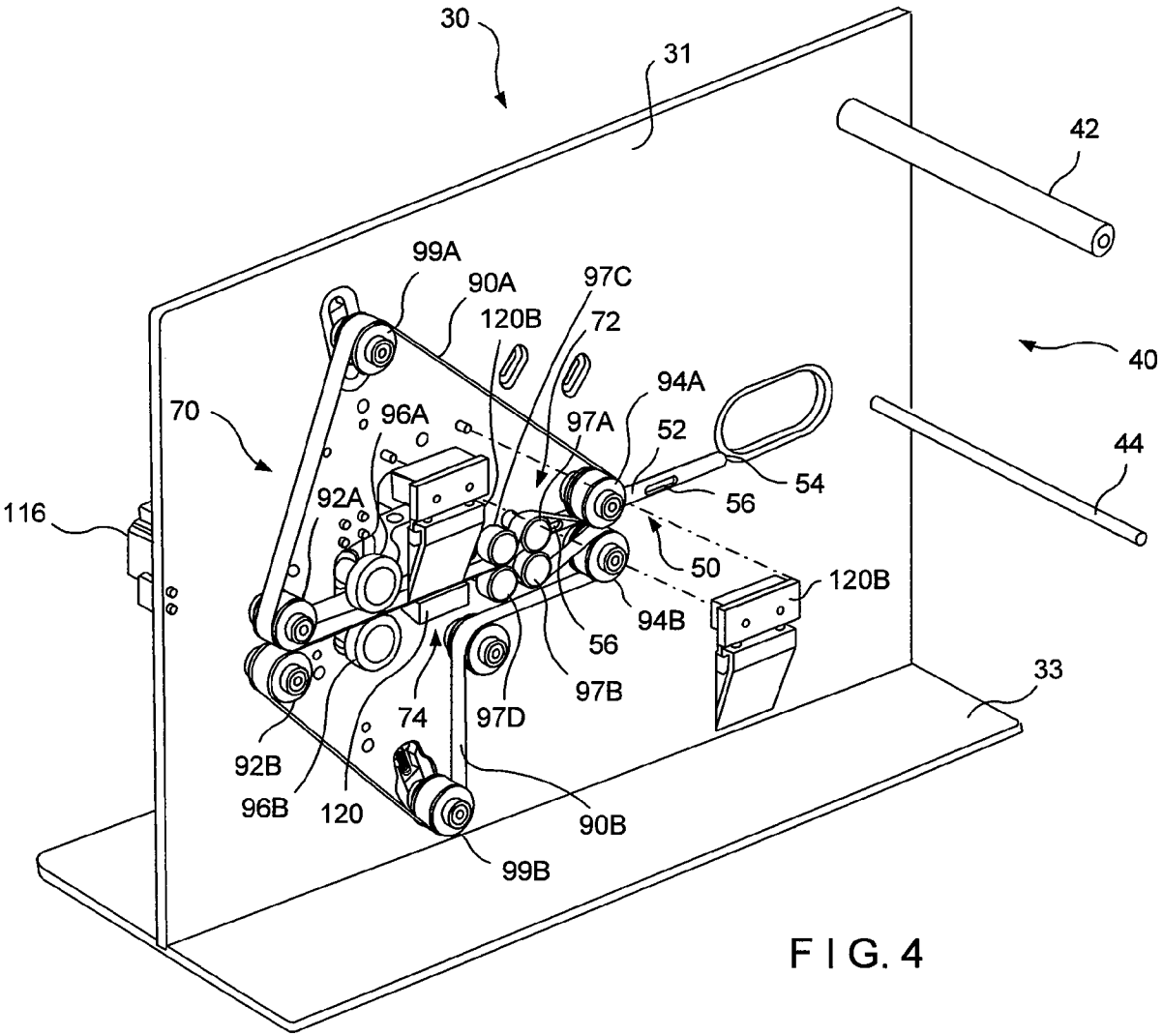
FIG. 4 is a perspective, assembled view of the inflation and sealing device of FIG. 3.

Referring to the embodiment of the inflation and sealing device shown in FIGS. 3 and 4, device 30 includes film support assembly 40, an inflation assembly 50 configured to be connected to an inflation gas supply preferably a pressurized air supply, such as an air pump, at open end 51, and a sealing assembly 70. The mechanisms can be partially or entirely covered by a housing. While device 30 will now be described with respect to inflation of the preferred film embodiment shown in FIGS. 1 and 2, it will be appreciated that device 30 can be used to inflate a variety of film structures having different configurations.

Film support assembly 40 is preferably configured for supporting a bulk supply of film of uninflated cushions, such as a roll 11 shown in FIG. 3. Preferably, support assembly 40 can accommodate rolls of film 11 that are at least about 5 inches in diameter. In a preferred example, roll 11 has a diameter of about 5 to 15 inches, and more preferably about 10 inches. In other embodiments, support assembly 40 can accommodate a roll of film with other dimensions, or a supply of film that is provided in other bulk forms, for example as a continuous stack of film material. Support assembly 40 preferably can support a weight of at least about 5 lbs, preferably at least about 10 lbs, and more preferably at least about 15 lbs, although typically no more than about 50 lbs is necessary to be supported. In an example, roll 11 has a weight of about 20 to 30 lbs. In other embodiments, the support assembly 40 can accommodate other weights.

As shown in FIG. 3, support assembly 40 includes an upper roller 42 and a lower roller 44. Upper roller 42 is configured for supporting roll 11 of film 10 about a central axis thereof, such that roll 11 can turn about roller 42 so as to unroll in a feed direction 35. Lower roller 44 is configured such that film 10 can pass thereover while it is being unrolled, allowing film 10 to redirect toward inflation assembly 50 such that film 11, and in particular inflation channel 23, is substantially aligned with inflation assembly 50 prior to engagement therewith regardless of the amount of film remaining on roll 11. An alternative support assembly is shown in U.S. patent application Ser. No. 11/867,452.

In the embodiment of FIG. 3, film 10 is pulled from roll 11, preferably by sealing mechanism 70, in the downstream direction 35 during the inflation and sealing operation. The major surface of the film 10 preferably extends substantially along and transversely to the downstream direction 35.

Inflation assembly 50 is preferably mounted to support 31, which includes a base 33. The inflation assembly 50 is positioned proximate sealing assembly 70, and is positioned within device 30 such that it is generally aligned with first longitudinal edge 12 and inflation channel 23 as film 10 is directed through device 30. Inflation assembly 50 is configured and oriented for inflating cushion cavities 28 of film 10 with air.

Inflation assembly 50 preferably includes a fluid conduit in the form of a nozzle 52. Nozzle 52 is connected at open end 51 to an air pump. Nozzle 52 is preferably tubular and extends in a longitudinal direction that is generally parallel to the downstream movement direction 35 of film 10. In a preferred embodiment, tip 54 of nozzle 52 has a tapered shape, although in other embodiments, tip 54 can have other configurations. Tip 54 is preferably smooth and rounded. As shown in FIGS. 3 and 4, tip 54 is preferably positioned just upstream from sealing assembly 70, although other suitable positions can alternatively be employed.

Nozzle 52 includes an outlet 56 from which inflation fluid is expelled to inflate the cushion cavities of film 10. Outlet 56 is preferably disposed near tip 54, but can alternatively or additionally be placed in different suitable locations. In the preferred embodiment, outlet 56 includes a lateral slot that extends along a portion of the longitudinal length of nozzle 52 and is positioned to direct air substantially transversely into the inflation channel 24 and the cushion cavities 28. Outlet 56 can have any suitable length. In an example, outlet 56 has a length that is longer than the perforation-to-perforation length 18 of film 10 to maximize the inflation efficiency of the air expelled from outlet 56 and into the cushion cavities. Preferably, cushions 28 are filled with air at an inflation pressure of at least about 3 psi, and more preferably at an inflation pressure of at least about 5 psi, and up to about 15 psi. In an example, the inflation pressure of cushions 28 is between about 5 psi and about 8 psi, but other inflation pressures can be used as desired. Nozzle 52 can include more than one outlet 56. In an example, a pair of outlets 56 is disposed diametrically opposite each other on the circumference of the nozzle. In another example, nozzle 52 includes three or more outlets 56 disposed around the circumference thereof.

The preferred inflation assembly 50 also includes a cutting device, which preferably a rotary cutter 58. Rotary cutter 58 has a disk-shaped cutting element 59 with a sharpened outer edge configured to rotate about axis 61. Cutting element 59 is preferably rotatably secured to support 31 such that it is partially disposed within slot 55 defined in the tubular wall of nozzle 52. Cutting element 59 extends into slot 55 by a distance 53 of at least about 0.01 inches. In a preferred embodiment, cutting element 59 extends into slot 55 by a distance of between about 0.03 inches 0.10 inches below the surface of the inflation nozzle 54. In an embodiment, cutting element 59 can extend into slot 55 by a distance of up to 0.25 inches. Slot 55 is preferably machined within the tubular wall avoiding or minimizing any leaks from nozzle 52. In an alternative embodiment, slot 55 can extend entirely through the wall of nozzle 52. Slot 55 is shown in FIGS. 1-6 as being disposed about nozzle 52 so as to be about 90" from the radial position of outlet 56; however other locations about nozzle 52 are possible. For example, slot 55 can be positioned radially opposite of outlet 56 (although not axially aligned). Cutting element 59 is positioned along nozzle 52 downstream from outlet 56, and is preferably adjacent sealing assembly 70, as shown in FIGS. 3 and 4. Cutting element 59 is made of any material suitable for cutting, such as a metal, and is preferably made from stainless steel. In an embodiment, cutting element 59 is made from hardened stainless steel. In a further embodiment, cutting element 59 is formed, at least on the outer edge, from heat treated or annealed metal which can include carbide or another material having suitable hardness characteristics for improved retention of the sharpness of the outer edge. At least the outside edge of cutting element 59 can be coated to increase the cutting ability and wear resistance, for example with titanium nitride or another material suitable for improving the wear resistance of the cutting element 58. Cutting element 59 preferably has a diameter of at least 314 inches, but can have a diameter of up to 2 inches. More preferably cutting element 59 has a diameter of about 1 inch. The outer cutting surface of cutting element 59 can be smooth or can include a plurality of cutting teeth such as at least two cutting teeth or up to 100 cutting teeth. An embodiment of cutting element includes between 50 and 75 cutting teeth, although more or fewer cutting teeth can be used, depending on the material characteristics of film 10, the desired smoothness of the cut, and the desired cutting speed.

Figure 5:
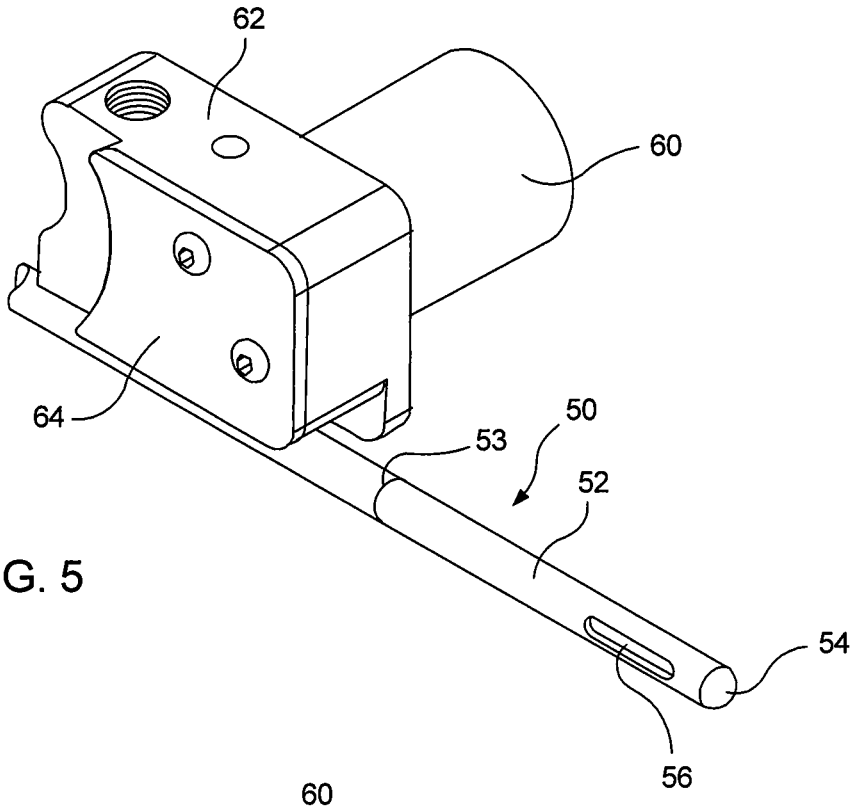
FIG. 5 is a perspective view of an inflation nozzle and a rotary cutter used to inflate a cushion and cut open a film layer, respectively, in accordance with an embodiment of the present invention.
Figure 6:
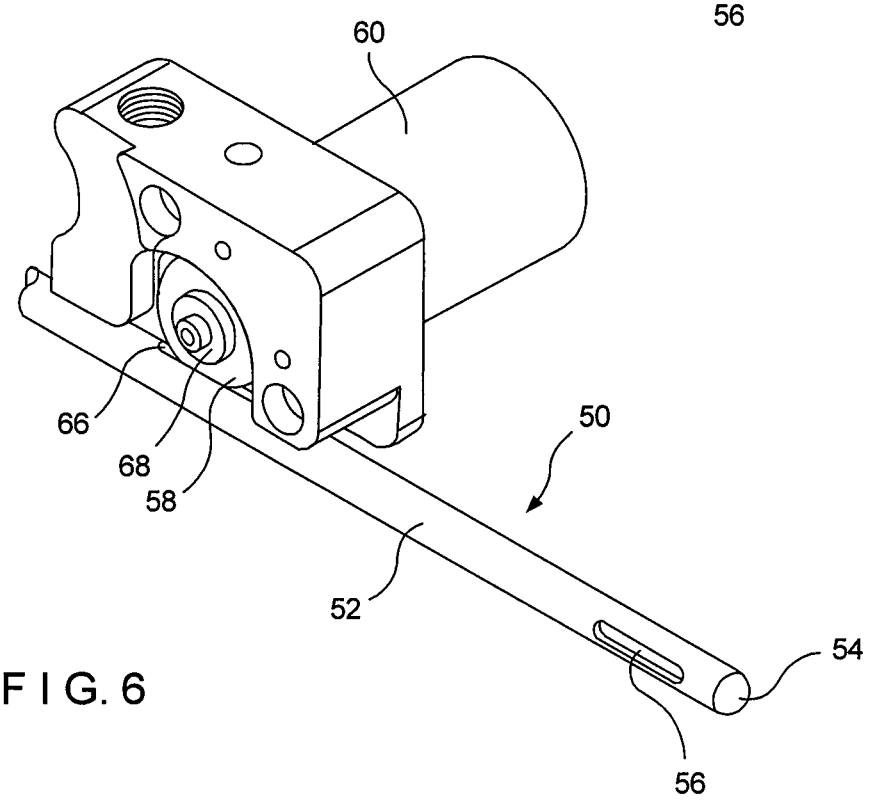
FIG. 6 is a perspective view thereof with a cover removed from the rotary cutter for clarity.

Cutting element 59 is affixed to the output end of motor 60 included in the rotary cutter 58 such that motor 60 causes cutting element 59 to rotate about axis 61 when device 30 is in use. Preferably, motor 60 causes cutting element 59 to spin in a direction such that the portion thereof that is disposed within slot 55 is moving substantially in downstream direction. The rotational speed of cutting element 59 is preferably selected to correspond to the thickness of film 10 and the desired feed rate of film 10 through sealing mechanism 70. As shown in FIGS. 5 and 6, motor 60 preferably has a housing 62, which includes a front cover 64. Housing 62 is configured to substantially conceal cutting element 59, which is done for safety purposes and to protect cutting element 59 from damage. Further, housing 62 can be configured to provide attachment for the assembly to support 31. The assembly of cutting element 59 to output end 64 of motor 60 preferably can include using a fastener 66 to secure cutting element 59, such as between a pair of washers 68 (of which only one is visible in FIG. 6).

Nozzle 52 is preferably configured to fit within inflation channel 23 such that inflation channel 23 is at least slightly under tension. This arrangement, shown in FIG. 8, causes a portion of film 10 included in inflation channel 23 to stretch over slot 55 under tension. Because cutting element 59 is configured to extend partially into slot 55, cutting element 59 engages a portion of inflation channel 23 as film moves in the downstream direction 35, which causes rotary cutter 58 to cut the film 10 along inflation channel 23, thereby forming a slit therein and opening inflation channel 23, as film 10 moves in the downstream direction 35 so that the film 10 can move off the nozzle 52, as shown in FIG. 7.

Figure 7:
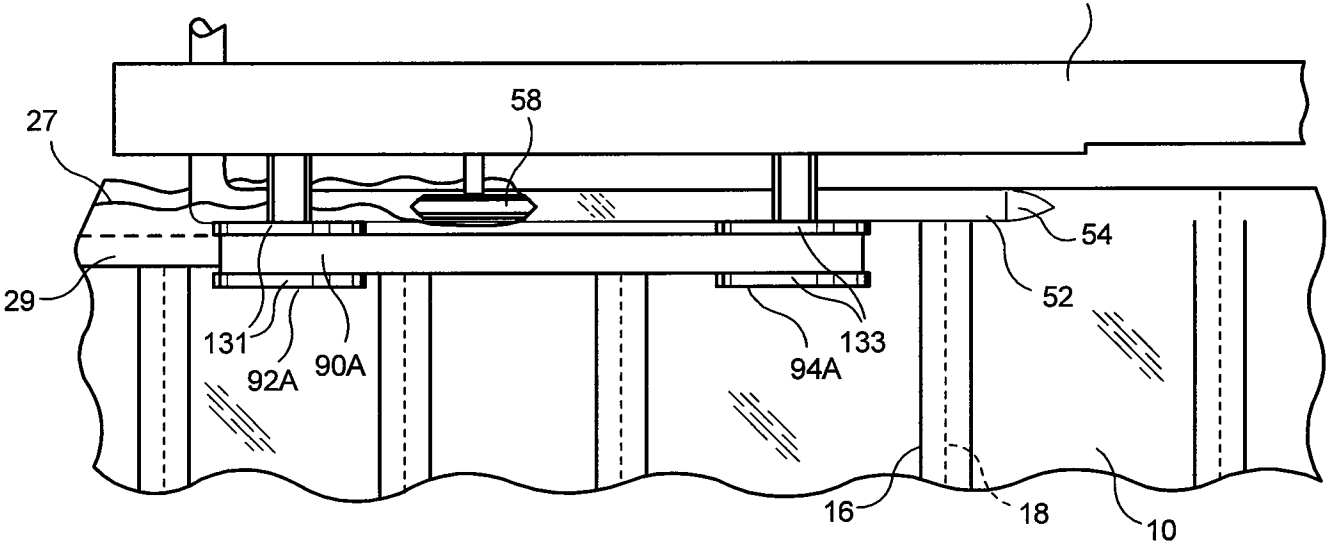
FIG. 7 is a top view of an embodiment of an inflation and sealing device shown during use thereof to inflate cushions of the film of FIG. 1.
Figure 8:
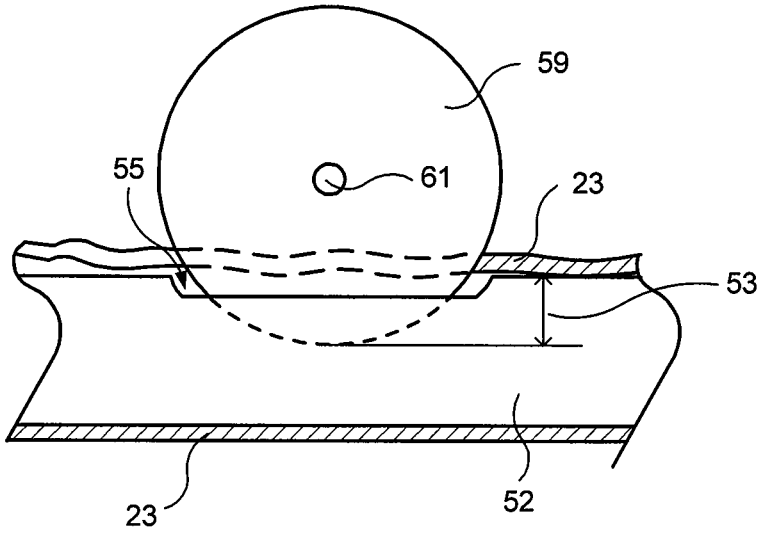
FIG. 8 is a front-side view of a cutting element of the inflation and sealing device of FIG. 3.

Rotary cutter 58 is preferably configured for cutting element 59 to cut film 10 after inflation of cushions 28 to allow film 10 to release nozzle 52, as shown in FIG. 7. More preferably, cutting element 59 cuts a portion of first or second film layers 20,22 near or adjacent to first longitudinal edge 12 of film 10 (i.e., at or adjacent to the sealing or overlapping portion 8), as film 10 is directed in the downstream direction 35, or near the inflation nozzle if located in a portion other than the edge. By cutting a portion of film 10, inflation assembly 50 is released from association with inflation channel 23 of inflated film 10 (e.g., between film layers 20,22).

The rotational cutting action used by rotary cutter 58, improves the speed at which inflation channel 23 can be cut over embodiments that used a fixed-blade arrangement for cutting. Accordingly, the feed-rate of film 10 in downstream direction 35 can be increased, allowing a higher number of cushions 28 to be inflated in a given period of time. For example, in a preferred embodiment of film 10, discussed above, having a length 17 of about 8 inches and a width of about 8 inches, the feed rate of film 10 can be about 50 and 20 feet per second. Further, the rotational cutting action of rotary cutter 58 allows for cutting of film 10 to be distributed along substantially the entire outside edge of the cutting element 59, rather than being limited to substantially a point along, for example, a fixed blade. This leads to increased blade life, which reduces cost and decreases downtime for replacing the cutting element.

In an embodiment, sealing assembly 70 can be similar to that which is described in U.S. Pat. No. 6,932,134 and is positioned within device 30 downstream from inflation outlet 56 of inflation assembly 50 so that cushions 28 of film 10 are sealed after being inflated. Sealing assembly 70 includes a first assembly portion 72 and a second assembly portion 74, between which film 10 is disposed. The preferred first and second portions 72,74 are arranged such that nozzle 52 is disposed vertically therebetween and horizontally and laterally beyond sealing portions 72,74 opposite from inflation cavity, as shown in FIG. 3. Preferably, first portion 72 includes a belt 90A arranged around at least belt supports, such as two end rollers 92A,94A and optionally one or more pressure rollers 96A to press the belt 90A against film 10 to press film 10 against second portion 74. Second portion 74 is preferably substantially identical to first portion 72, and can include a belt 90B arranged around two end rollers 92BY94B and pressure roller 96B to press belt 90B against film 10 to press film 10 against pressure roller 96A. Sealing elements 120A,120B are positioned within second portion first portion 72 and second portion 74, respectively, and are preferably substantially aligned with rotary cutter 58. As shown in FIG. 3, sealing element 120B is preferably positioned directly over cutting element 59. The arrangement of elements of the sealing assembly 70 is configured to hold film 10 between belts 90A,90B so as to advance film 10 in direction 35, with belts 90A,90B guiding film 10 in that direction.

As film 10 moves in the downstream direction 35, belts 90A,90B cooperatively apply pressure and hold the film layers 20,22 against each other along the sealing assembly 70 sufficiently tightly to prevent air within the inflated cushion cavities from leaking during the rest of the sealing process. To provide a maximum pinching pressure between belts 90A, 90B and film layers 20,22, the spacing between belt 90A and belt 90B is preferably minimized. Preferably, belts 90A,90B.

After being pressed between belts 90A, 90B and either just before, just after or concurrently with being cut, film 10 is directed to sealing elements 120A,120B, which are positioned over a portion of belt 90B. Sealing elements 120A, 120B are configured to produce a uniform seal with no gaps or pockets that would allow air to escape from the cushion cavities. Sealing elements 120A,120B are further configured and positioned to directly contact belt 90B and to press it down against film 10 therebelow. The heat transferred to film 10 through belt 90B is sufficient to melt or otherwise close and seal film 10.

To operate device 30, lead end 6 of film 10 is pulled from supply roll 11 and directed to inflation assembly 50. The inflation channel 23 is fed over the nozzle 52 of the inflation assembly 70 through lead opening 24. Lead end 6 of film 10 is then manually directed between belt 90A and belt 90B of the sealing assembly 70, where the sealing portion 8 of the film is pinched between pressure rollers 96A,96B. Once the gear and motor system associated with the pressure rollers 96A,96B is initiated and sealing surface 122 is heated, for example by turning on a power source of device 30, the remainder of the manufacturing process is automated, as film 10 is continuously pulled from supply roll 11 and directed to nozzle 52 for inflation, rotary cutter 58 for cutting, and sealing elements 120A,120B for sealing.

Various other embodiments of devices for inflating cushions 24 in a film 10 can be configured to replace a fixed-blade cutting mechanism with a rotary cutter 58 in accordance with the present invention. For example, commonly-assigned U.S. Provisional Patent Application No. 60/846,188 discloses a cushion inflating and sealing device that employs a rotary-sealing mechanism. The device further uses an inflation assembly having a nozzle with a fixed blade extending therefrom for cutting open the inflation channel of a film subsequent to inflation of cushions formed therein. Such a device can be outfitted with a rotary cutter as described herein to replace the blade associated with the inflation assembly. Similarly, commonly-assigned U.S. Provisional Patent Application No. 60/979,640 discloses a cushion inflating and sealing device with a disengagement mechanism. The device described therein uses an inflation assembly having a nozzle with a fixed blade extending therefrom for cutting open the inflation channel of a film subsequent to inflation of cushions formed therein. Such a device can be outfitted with a rotary cutter as described herein to replace the blade associated with the inflation assembly. In a similar manner, other cushion inflating and sealing devices can be outfitted with a rotary cutter of the present invention.

In addition to the mechanisms described herein, it will be appreciated that the device 30 can include various supplementary mechanisms and control functions. For example, the device 30 can include a central controller, a monitor, control signals, and feedback systems. Further, the device 30 advantageously requires only standard power utility requirements, such as by being capable of plugging into a standard wall outlet of 120 or 240 VAC, and 15 amp, and therefore can be operated with a simple on-off switch.

Figure 9:
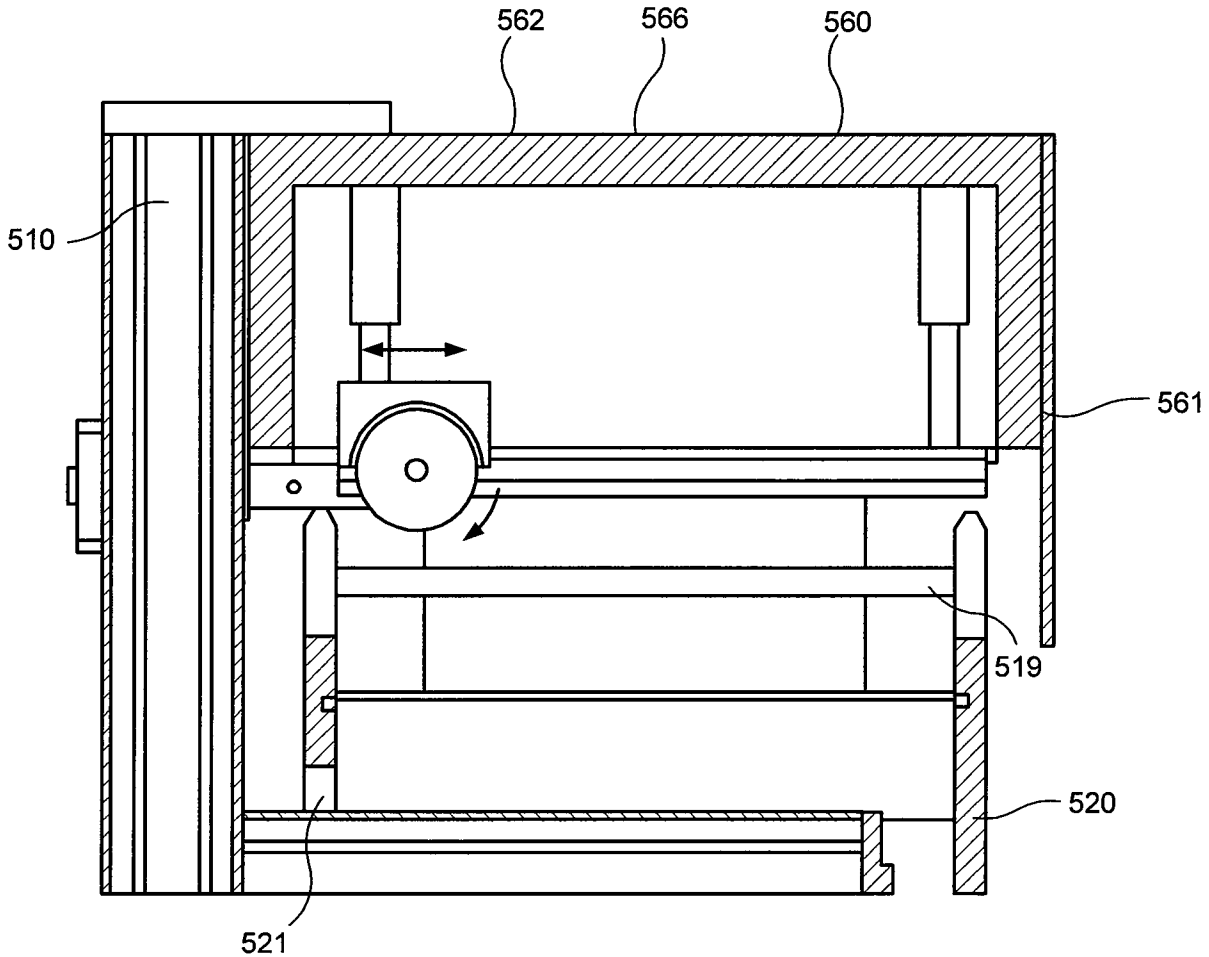
FIG. 9 is a perspective view of a film handling device including a rotary cutter in accordance with a further embodiment of the present invention.

In a further embodiment, a embodiment of the rotary cutter described herein can be used in an automated pillow dispenser in order to facilitate the separation of an inflated film between adjacent pillows. An example of a dispenser device is disclose in U.S. patent application Ser. No. 11/867,452. In such an embodiment, shown in FIG. 9, a rotary cutter 558 can be assembled within the device so as to travel in a direction 530 perpendicular to the direction of travel of the film so as to form a longitudinal cut in film 1. Preferably, in such an embodiment the rotation of the cutting element 559 is substantially faster than the linear motion of the rotary cutter 558 and is in a direction such that the portion of the disk that makes contact with film 10 is moving in a substantially downward direction while slicing the film. Preferably, rotary cutter 558 is mounted on a track 580 to allow it to travel linearly, which may be controlled by a suitable motor. Further, track 580 can be configured to move in a substantially vertical direction 532, for example by actuation of pistons 582, to allow free movement of the inflated cushions through the device. In use, the device is configured to detect the position of the inflated cushions so as to align the rotary cutter with transverse seals 16 between cushions. The device then stops movement of the film 10 after the desired number of cushions has been dispensed and separates the dispensed cushions using rotary cutter 558.

All of the references specifically identified in the detailed description section of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A method for inflating and sealing an inflatable cushion, comprising:

pulling the inflatable cushion in a longitudinal direction over a substantially stationary fluid conduit, the fluid conduit including a recessed portion, the fluid conduit configured for inflating with a fluid a cushion cavity and configured for longitudinal reception in an inflation channel;

engaging the inflation channel with the fluid conduit;

inflating the cushion cavity disposed between first and second layers of film by directing a flow of a fluid through the inflation channel adjacent to and in fluid communication with the cushion cavity such that the fluid flows into the cushion cavity, wherein the inflation channel is formed from two overlapping portions of the film that are juxtaposed with one another on two sides of the inflation channel;

powering a cutting disk to rotate relative to the fluid conduit, the cutting disk positioned stationary relative to the substantially stationary fluid conduit, wherein the cutting disk partially extends into the recessed portion of the fluid conduit;

cutting open the inflation channel in the longitudinal direction during the pulling of the inflatable cushion using the rotating cutting disk; and sealing the overlapping portions to each other so as to form a longitudinal seal configured to seal the fluid in the cushion cavity.

2. The method of claim 1, further comprising the steps of:

pulling the inflatable cushion over a fluid conduit; and inflating the cushion cavity by injecting fluid from the fluid conduit.

3. The method of claim 1, wherein the recessed portion is an aperture extending through a wall of the inflation conduit.

4. An inflatable-cushion inflation and sealing device, comprising:

an inflation assembly including a fluid conduit configured for inflating with a fluid a cushion cavity disposed between first and second layers of film and configured for longitudinal reception between first and second overlapping portions of an inflation channel adjacent to and in fluid communication with the cushion cavity, the fluid conduit including a recessed portion;

a driving mechanism configured to pull the inflation channel in a longitudinal direction over the fluid conduit and through a sealing assembly;

a rotary cutting element disposed proximate the fluid conduit, wherein the rotary cutting element partially extends into the recessed portion of the fluid conduit, the rotary cutting element configured and oriented to longitudinally cut open the inflation channel from about the fluid conduit in the longitudinal direction by a cutting motion that includes rotation of the rotary cutting element; and the sealing assembly configured to seal the overlapping portions to each other and to form a longitudinal seal configured to seal the fluid in the cushion cavity.

5. The device of claim 4, wherein the first and second overlapping portions are juxtaposed against one another on two sides of the inflation channel and wherein the cutting element is configured and oriented to cut open the inflation channel to provide an exit from the inflation channel for the fluid conduit.

6. The device of claim 4, wherein the cutting element is in the form of a disk having an outer edge configured for cutting the film at the inflation channel.

7. The device of claim 6, wherein the disk has at least about fifty up to about one hundred cutting points disposed along the outer edge.

8. The device of claim 7, wherein the cutting motion is a spinning motion.

9. The device of claim 7, wherein the cutting element is at a fixed location with respect to the fluid conduit.

10. The device of claim 7, wherein the sealing assembly includes the driving mechanism.

11. The device of claim 6, wherein:

the driving mechanism is configured for driving the overlapping portions through the sealing assembly at a first speed along a sealing direction to form the longitudinal seal of the overlapping portions, and the cutting element is powered to rotate to move the outer edge at a second speed that is at least equal to the first speed.

12. The device of claim 11, wherein the driving mechanism comprises the sealing assembly.

13. The device of claim 11, wherein the second speed is greater than the first speed.

14. The device of claim 6, wherein the outer edge comprises carbide or diamond.

15. The device of claim 4, wherein the cutting element is associated with a motor configured to cause the rotation of the cutting element.

16. The device of claim 4, wherein:

the fluid conduit defines an outlet configured for supplying fluid into the cushion cavity and an inlet for receiving a fluid to be supplied into the cushion cavity, and the fluid conduit is configured such that the first overlapping portion extends over the recessed portion;

the recessed portion is disposed between the inlet portion and the outlet; and a portion of the cutting element extends into the recessed portion to cut open the inflation channel in an area where the first overlapping portion extends over the recessed portion.

17. The device of claim 4, wherein the cutting member is in the form of a disk having a diameter of between about 0.7 inches and 2 inches, and wherein the cutting member extends into the recessed portion by a distance of between about 0 and 0.2 inches.

18. The device of claim 4, wherein the sealing assembly is configured for receiving the first and second overlapping portions and for driving the overlapping portions along a sealing direction to form the longitudinal seal.

19. The device of claim 18, wherein the rotation of the cutting element is such that the portion thereof cutting the film moves in the sealing direction.

20. The device of claim 18, wherein the sealing assembly includes a heating element configured to heat the overlapping portions under pressure for sealing the overlapping portions together.

21. The device of claim 4, wherein the rotary cutting element has an axis of rotation positioned in a fixed location relative to the fluid conduit, and wherein the edge of the rotary cutting element moves relative to the fluid conduit.

22. An inflatable-cushion inflation and sealing device, comprising:

an inflation assembly configured for inflating with a fluid a cushion cavity disposed between first and second layers of film, the inflation assembly including a fluid conduit having a cutting element opening configured for longitudinal reception between first and second overlapping portions of an inflation channel adjacent to and in fluid communication with the cushion cavity;

a cutting element located at least partially in the cutting element opening of the fluid conduit disposed proximate the fluid conduit and configured and oriented to cut open the inflation channel by a cutting motion that includes rotation of the cutting element; and a sealing assembly disposed adjacent the cutting element and configured to seal the overlapping portions to each other and to form a longitudinal seal configured to seal the fluid in the cushion cavity.

23. The device of claim 22, wherein the cutting element is oriented in a longitudinal direction, and further comprising:

a driving mechanism configured to pull the inflation assembly in the longitudinal direction.

24. The device of claim 22, further comprising a motor that rotates the cutting element.

25. The device of claim 22, wherein the cutting element opening is a recess.

26. The device of claim 22, wherein the cutting element opening is an aperture extending through the fluid conduit.

* * * * *